US007954986B2

(12) United States Patent
Ishizu et al.

(10) Patent No.: US 7,954,986 B2
(45) Date of Patent: Jun. 7, 2011

(54) VEHICLE LIGHT AND METHOD FOR MANUFACTURING THE SAME

(75) Inventors: Motoyasu Ishizu, Tokyo (JP); Kazuo Yoshikawa, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 198 days.

(21) Appl. No.: 12/240,095

(22) Filed: Sep. 29, 2008

(65) Prior Publication Data

US 2009/0122569 A1 May 14, 2009

(30) Foreign Application Priority Data

Sep. 28, 2007 (JP) ..... 2007-254541

(51) Int. Cl.
*F21V 11/00* (2006.01)

(52) U.S. Cl. ..... 362/509; 362/538

(58) Field of Classification Search ..... 362/509, 362/520, 538, 540, 541, 542; 445/3, 8, 58
See application file for complete search history.

(56) References Cited

U.S. PATENT DOCUMENTS

| | | | | |
|---|---|---|---|---|
| 5,684,633 | A | 11/1997 | Lutz et al. | |
| 5,931,566 | A * | 8/1999 | Fraizer | 362/540 |
| 6,435,702 | B1 * | 8/2002 | Aikawa et al. | 362/509 |
| 2001/0007695 | A1 | 7/2001 | Aikawa et al. | |
| 2005/0068783 | A1 | 3/2005 | Egashira et al. | |

FOREIGN PATENT DOCUMENTS

| | | | |
|---|---|---|---|
| DE | 199 60 802 | A1 | 6/2000 |
| DE | 10 2004 046 408 | A1 | 3/2006 |
| JP | 6-50113 | U | 7/1994 |
| JP | 2000-182409 | A | 6/2000 |
| WO | 03/038335 | A1 | 5/2003 |

OTHER PUBLICATIONS

Japanese Office Action for Japanese Patent Application No. 2007-254541 dated Aug. 18, 2009 along with partial English translation.
International Search Report for EP 08 01 6908 dated Mar. 25, 2010.

* cited by examiner

*Primary Examiner* — Y My Quach Lee
(74) *Attorney, Agent, or Firm* — Kenealy Vaidya LLP

(57) ABSTRACT

A vehicle light can have a simple configuration for easily determining whether or not a coating, such as an anti-fog coating and a hard coating, has been applied to a lens. A manufacturing method of such a vehicle light is also disclosed. The vehicle light can include a housing opened in an illumination direction, a light source disposed within the housing, a reflecting surface disposed within the housing and configured to reflect light from the light source to the illumination direction, and an outer lens disposed so as to hermetically close the front open end of the housing. The outer lens can have an inner surface and an outer surface, at least one of which including a coating for surface treatment. The outer lens can further have a first area which is subjected to a texturing process on the inner surface and/or the outer surface, with at least part of the first area including the coating for surface treatment.

19 Claims, 4 Drawing Sheets

VEHICLE LIGHT AND METHOD FOR MANUFACTURING THE SAME

This application claims the priority benefit under 35 U.S.C. §119 of Japanese Patent Application No. 2007-254541 filed on Sep. 28, 2007, which is hereby incorporated in its entirety by reference.

BACKGROUND

1. Technical Field

The presently disclosed subject matter relates to a vehicle light such as a vehicle headlight, an auxiliary headlight, a rear combination lamp, and the like, having an outer lens. The presently disclosed subject matter also relates to a method for manufacturing the same.

2. Description of the Related Art

In a conventional vehicle light including an outer lens, moisture may enter the inside of the light during use. The moisture that enters can adhere to the inner surface of the outer lens resulting in mist on the lens. In order to prevent this, the inner surface of the outer lens may include an anti-fog coating applied thereto.

In this case, such an anti-fog coating should be transparent. Accordingly, when a completed product including the outer lens is observed, it is difficult to determine whether such a transparent anti-fog coating has been applied or not.

In order to determine whether this anti-fog coating has been applied, conventional techniques include providing a boundary line near a coating mask formed on an outer lens at an unnoticeable position. After removing the coating mask, one can determine whether the transparent anti-fog coating has been applied or not by visually inspecting and determining the presence or absence of the boundary line on the outer lens.

However, it is not easy to determine whether the anti-fog coating has been applied by visual inspection of such a boundary line. Furthermore, there is no other fallback determination method. If a partially finished product that does not include the anti-fog coating comes to be mixed into the final assembly process of the vehicle lamp after the anti-fog coating process, the resulting finished products contain defective uncoated products which cannot be clearly distinguished from the nondefective coated products.

The determination of whether a coating has been applied or not is also used for other transparent coatings for surface treatment, such as a hard coating for an outer surface of an outer lens. If the determination has not been carried out, an uncoated product may be mixed into a group of coated products.

SUMMARY

The presently disclosed subject matter was devised in view of these and other characteristics, problems and in association with the conventional art. According to an aspect of the presently disclosed subject matter, a vehicle light can be provided with a simple configuration by which determination as to whether a coating, such as an anti-fog coating, a hard coating for surface treatment, and the like has been applied is facilitated. Furthermore, according to another aspect of the presently disclosed subject matter, a method for manufacturing such a vehicle light can be provided.

According to another aspect of the presently disclosed subject matter, a vehicle light can include: a housing having a front open end opened in a front direction or an illumination direction; a light source disposed within the housing; a reflecting surface disposed within the housing, configured to reflect light from the light source to the illumination direction, the reflecting surface being concave toward the illumination direction; and an outer lens disposed in front of the reflecting surface so as to hermetically close the front open end of the housing. The outer lens has an inner surface and an outer surface at least one of which is applied with a coating for surface treatment. In this configuration, the outer lens further has a first area which is subjected to texturing process on any of the inner surface and the outer surface and at least part of the first area is applied with the coating for surface treatment.

In the vehicle light according to the disclosed subject matter, the outer lens may have a second area which is adjacent to the first area and is not subjected to texturing process, at least part of the second area being applied with the coating for surface treatment.

In the vehicle light according to the disclosed subject matter, the outer lens and the housing may be bonded to each other at a bonding area which may include at least part of, or all of, the first area and the second area of the outer lens.

In the vehicle light according to the disclosed subject matter, the coating for surface treatment may include an anti-fog coating for the inner surface of the outer lens and a hard coating for the outer surface of the outer lens.

According to still another aspect of the presently disclosed subject matter, a method for manufacturing a vehicle light can include: forming an outer lens having an inner surface and an outer surface with a first area which is subjected to texturing process on any of the inner surface and the outer surface; applying an area for coating on any of the inner surface and the outer surface of the outer lens with a coating for surface treatment; and fixing the outer lens to a housing of a vehicle light. In the applying of the coating, at least part of the first area of the outer lens is applied with the coating for surface treatment.

In the manufacturing method according to the disclosed subject matter, in the applying of the coating, the outer lens may have a second area which is adjacent to the first area and is not subjected to texturing process and at least part of the first area and part of the second area are included in the area for coating.

The manufacturing method according to the disclosed subject matter may further include, after the applying of the coating and prior to the fixing of the outer lens to the housing, determining whether the outer lens is properly coated with the coating or not based on a state of the first area and the second area which have been coated or not.

In the manufacturing method according to the disclosed subject matter, the determination of whether the outer lens is properly coated with the coating or not can be achieved by visually inspecting the state of the first area and the second area which have been coated or not.

In the manufacturing method according to the disclosed subject matter, the determination of whether the outer lens is properly coated with the coating or not can be achieved by optically measuring any of a transparency and a reflectance of the first area and the second area which have been coated or not.

In the manufacturing method according to the disclosed subject matter, the coating for surface treatment may include an anti-fog coating for the inner surface of the outer lens and a hard coating for the outer surface of the outer lens.

In the configuration of the vehicle light as described above, light which is emitted from the light source and incident on the reflecting surface is reflected by the reflecting surface and irradiated toward the front in the illumination direction via the outer lens.

In this instance, the outer lens has the first area which is subjected to texturing process at the same time when the outer lens is molded or as a postprocess. Accordingly, at least part of the first area where the texturing process has been applied is applied with the coating for surface treatment such as an anti-fog coating on the inner surface of the outer lens or a hard coating on the outer surface of the outer lens. In this case, the fine irregularities of the first area by texturing process are covered with the coating film to disappear. Namely, this can smoothen the surface of the first area of the outer lens which has been applied with the coating to provide a very flat and smooth surface at the first area.

When one visually inspects the first area, he/she cannot visually confirm the texturing processed surface at the portion where a coating for surface treatment has been provided. Accordingly, the determining of whether the outer lens is properly coated or not can be easily achieved simply by visually inspecting the first area of the outer lens and determining whether the texturing processed surface can be observed, namely, whether the coating can properly cover the first area.

When part of the first area has not been applied with a coating for surface treatment, one can visually inspect the texturing processed surface where no coating is provided, with ease. Accordingly, even when the application process has been finished properly or not, any defective product which has not been properly applied with a coating can be detected based on the state of the first area.

Furthermore, when the first area is applied with a coating for surface treatment, the irregularities of the texturing processed surface can be smoothened. As a result, the optical characteristics including the transparency, the reflectance and the like of that portion may be changed. When transmittance or reflectance of the portion of the first area that is applied with the coating for surface treatment is optically determined, the determination of whether the outer lens is properly coated or not can be achieved by the difference between the detected values before and after the application process.

In the above configuration, the outer lens can include the second area which is adjacent to the first area and is not subjected to the texturing process, and part of the first area and the second area can be applied with the coating for surface treatment. In this case, the first area having been subjected to texturing process and the second area not having been subjected to texturing process are compared with each other with regard to the application of the coating for surface treatment. Accordingly, the determination of whether the coating has been present or not can be more easily achieved.

The bonding area where the outer lens and the housing are bonded to each other may include at least part of, or all of, the first area and the second area of the outer lens. When both the entire first area and the entire second area are included in the bonding area, the first and second areas are positioned near the bonding area of the housing when assembled. Accordingly, when light from the light source of the vehicle light is reflected by the reflecting surface and passes through the outer lens, the light does not pass through the first area and/or the second area. This means that the illumination light can be projected with a predetermined light distribution pattern without any effect by the first area and/or the second area. Further, if the bonding area and its surroundings do not affect the light distribution pattern, part of or all of the first area and/or the second area can be located outside the bonding area.

As described above, in accordance with the presently disclosed subject matter, a vehicle light can be provided with a simple configuration by which determination as to whether a coating such as an anti-fog coating, a hard coating for surface treatment, and the like has been applied or not can be easily accomplished. Furthermore, according to the presently disclosed subject matter, a method for manufacturing such a vehicle light can be provided.

BRIEF DESCRIPTION OF THE DRAWINGS

These and other characteristics, features, and advantages of the presently disclosed subject matter will become clear from the following description with reference to the accompanying drawings, wherein.

DETAILED DESCRIPTION OF EMBODIMENTS

A description will now be made below to exemplary embodiments of vehicle lights made in accordance with principles of the presently disclosed subject matter with reference to the accompanying drawings.

Figure 1:
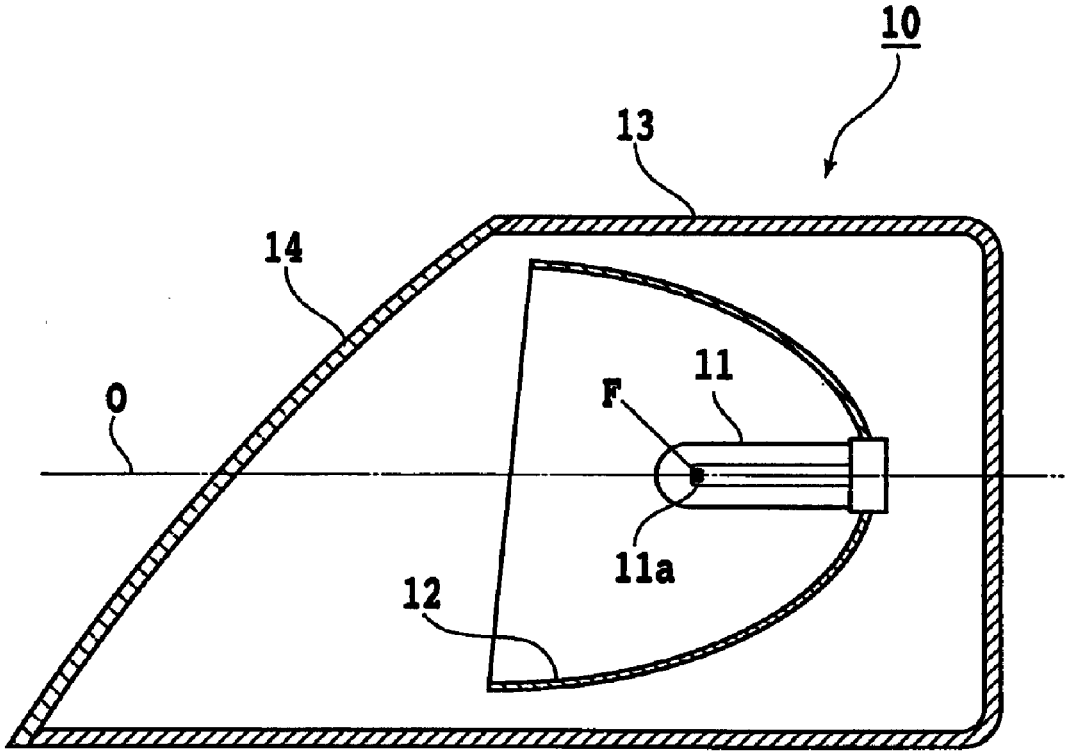
FIG. 1 is a schematic cross-sectional view showing the configuration of a vehicle light in accordance with a first exemplary embodiment of the presently disclosed subject matter.

FIG. 1 shows the configuration of a vehicle light in accordance with a first exemplary embodiment of the presently disclosed subject matter.

In FIG. 1, the vehicle light 10 can be configured as a vehicle headlight. The vehicle light 10 can include: a bulb 11 serving as a light source; a reflecting surface 12 configured to reflect light from the bulb 11 to the front direction of the vehicle (or in the illumination direction for the vehicle light); a housing 13 configured to hermetically house the bulb 11 and the reflecting surface 12; an extension 17 covering the area near the open ends of the reflecting surface 12 and the housing 13 so that the housing 13 is prevented from being directly observed through the outer lens 14 when the vehicle light 10 is seen from the front side; and an outer lens 14 configured to hermetically close the front open end of the housing 13.

The bulb 11 is one for use in a general vehicle headlight or an auxiliary headlight. Examples of the light source can include an incandescent lamp, a halogen lamp, a discharge lamp such as a high intensity discharge lamp (HID lamp), an LED, and so on. The bulb 11 can be arranged almost horizontally so that its optical axis O is directed forward. The bulb 11 is fixedly held by a socket so that power can be fed therethrough to the bulb 11. The bulb 11 has its light emitting portion 11*a* extending and arranged along the optical axis O.

The reflecting surface 12 can be configured to reflect light from the bulb 11 to the front direction and is concave toward the front direction. The reflecting surface 12 can be composed of a revolved paraboloid. The revolved paraboloid of the reflecting surface 12 has its focal point F disposed substantially at (i.e., at or near) the light emitting portion 11*a* of the bulb 11. Furthermore, the revolved paraboloid can have its longer axis disposed so as to coincide with the optical axis O extending in the illumination direction.

Further, the revolved paraboloid may include a free curved surface derived from a paraboloid.

The housing 13 can be formed of an opaque material so that light cannot pass therethrough. The housing 13 can house the bulb 11 and the reflecting surface 12 so as to hermetically surround them. Furthermore, the housing 13 is opened toward the front in the illumination direction so that light can be emitted from this open end of the housing 13.

The outer lens 14 can be formed of a transparent material. The periphery of the outer lens 14 is hermetically bonded to the periphery of the opening of the housing 13. This configuration can prevent dust and other fine materials from entering the light path extending from the reflecting surface 12 via the outer lens 14 to the outside.

The outer lens 14 is coated with an anti-fog coating on its inner surface and a hard coating on its outer surface in this exemplary embodiment.

The above configuration of the vehicle light can be similar to that of a conventional vehicle light. However, the vehicle light 10 is different from the conventional vehicle light in at least the following points.

Figure 2:
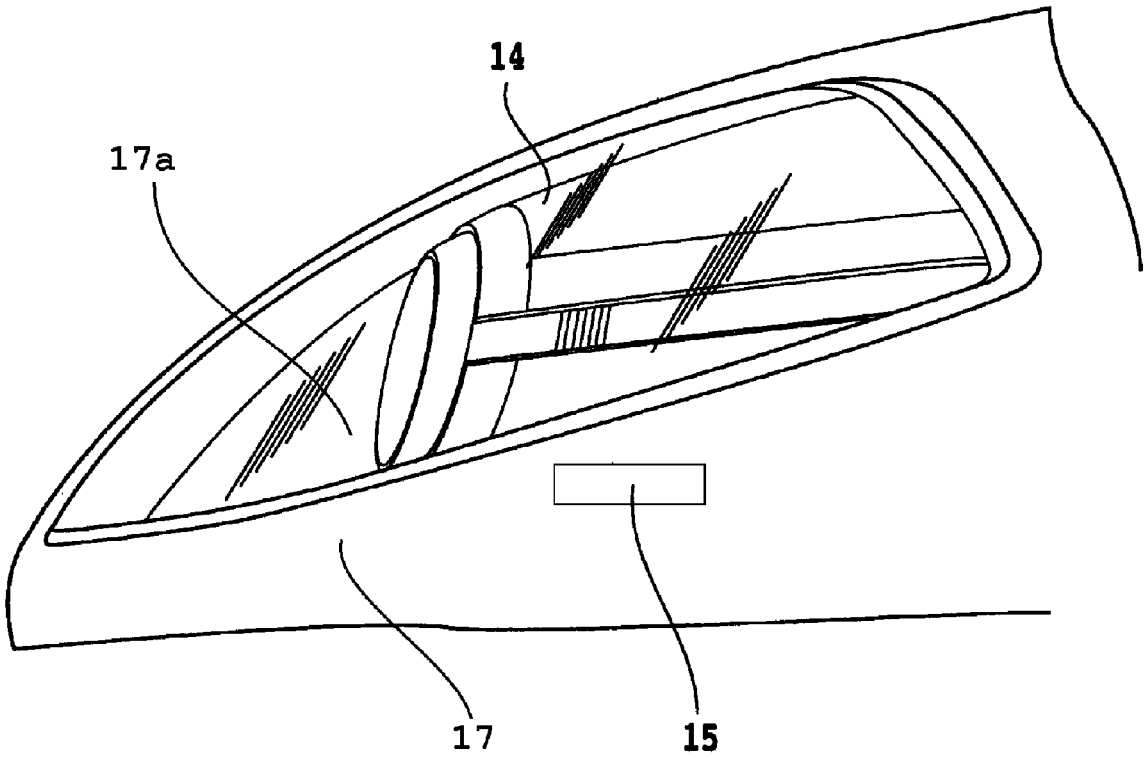
FIG. 2 is a side view showing the vehicle light of FIG. 1 in detail.

The outer lens 14 includes a first coating determination portion 15 formed on its inner surface at a predetermined location, as shown in the side view of FIG. 2.

Figure 3:
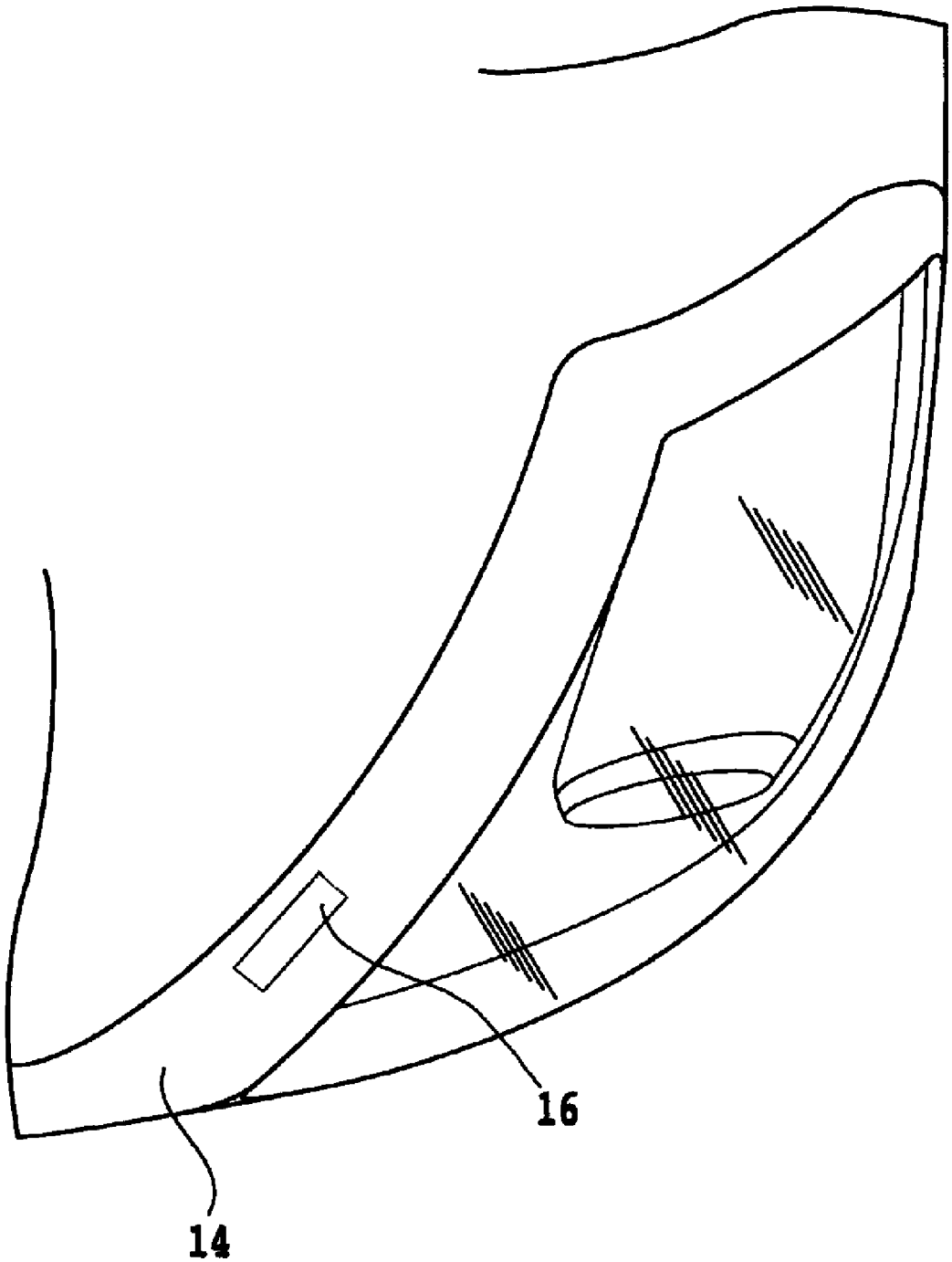
FIG. 3 is a plan view showing the vehicle light of FIG. 1 in detail.

In addition to this, the outer lens 14 can further include a second coating determination portion 16 formed on its outer surface at a predetermined location, as shown in the side view of FIG. 3.

The first coating determination portion 15 can be disposed, as shown in FIG. 2, on the inner surface of the outer lens 14 near the bonding area with the housing 13 so as to be partly located within the bonding area (in FIG. 2, the portion 15 is shown with a solid line). Specifically, the first coating determination portion 15 can be disposed at a position facing the extension 17 around a lighting chamber 17*a* which envelopes the bulb 11 and the reflecting surface 12, and at the same time, positioned at a sideward and lower position near the periphery of the vehicle light 10. If the first coating determination portion 15 is disposed at a position directly facing the lighting chamber 17*a*, it may be included within a light path of light emitted from the vehicle light 10. In order to prevent it from hindering the light being emitted, it can be located outside the light path. Accordingly, the first coating determination portion 15 is formed on the inner surface of the outer lens 14 at a position facing towards the extension 17 and near the bonding area between the extension 17 and the housing 13.

Figure 4:
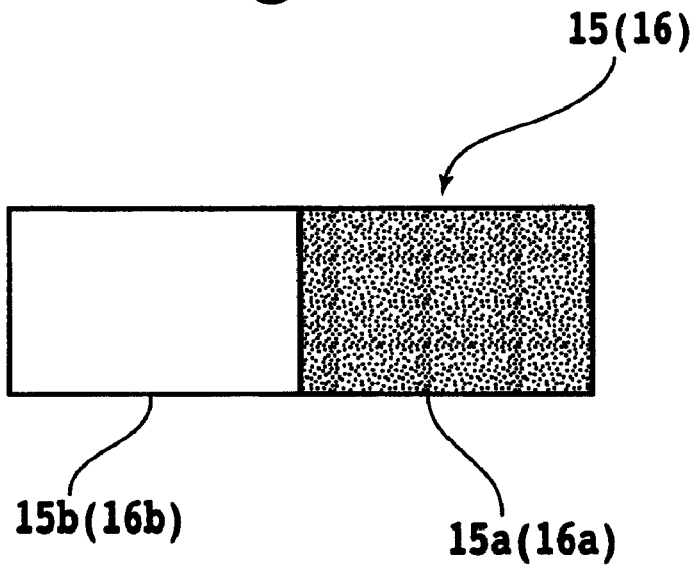
FIG. 4 is a schematic view showing the configuration of a first coating determination portion (or a second coating determination portion) of the vehicle light of FIG. 1.

The first coating determination portion 15 is formed in the form of a rectangle extending in one direction, as shown in FIG. 4, and is divided into two areas, a first area 15*a* and a second area 15*b* divided at its longitudinal center.

The first area 15*a* is subjected to a texturing process on its surface. The texturing process may be achieved at the same time when the outer lens 14 is molded with a metal mold by, for example, injection molding, or as a postprocess after molding the outer lens 14. Furthermore, the texturing process may be achieved, for example, by providing a metal mold for the outer lens that is processed with sand blasting or etching at an area corresponding to the first area, or by directly sand blasting or etching the first area. However, the presently disclosed subject matter is not limited to these examples of processing or shaping the first area.

Conversely, the second area 15*b* is not processed, and accordingly, the surface of the second area 15*b* is substantially smooth.

When an anti-fog coating is applied to the inner surface of the outer lens 14, the above first coating determination portion 15 including the first area 15*a* and the second area 15*b* is also simultaneously applied with the same anti-fog coating.

On the other hand, as shown in FIG. 3, the second coating determination portion 16 is disposed on the outer surface of the outer lens 14 near the bonding area with the housing 13 so as to be at least partly located within the bonding area.

The second coating determination portion 16 is, as shown in FIG. 4, formed in the form of a rectangle extending in one direction and is divided into two areas, a first area 16*a* and a second area 16*b* divided at its longitudinal center.

In this instance, the first area 16*a* is subjected to texturing process on its surface.

The texturing process may be achieved at the same time when the outer lens 14 is molded with a metal mold or as a postprocess after molding the outer lens 14.

Conversely, the second area 16*b* is not processed, and accordingly, the surface of the second area 16*b* is substantially smooth.

When a hard coating is applied to the outer surface of the outer lens 14, the hard coating is simultaneously applied to the above referenced second coating determination portion 16 including the first area 16*a* and the second area 16*b* with the same.

The vehicle light 10 in accordance with the presently disclosed subject matter can be configured as described above, and can emit light when the light emitting portion 11*a* of the bulb 11 is supplied with power. The light from the bulb 11 is reflected by the reflecting surface 12 to become parallel light and then is projected forward in the illumination direction through the outer lens 14.

In the above vehicle light 10, the first area 15*a* and the second area 15*b* of the first coating determination portion 15 are not coated before the anti-fog coating is applied to the inner surface of the outer lens 14. Accordingly, when the first coating determination portion 15 is visually inspected, the texturing processed first area 15*a* can be observed as it is, meaning the irregularities can be observed. The second area 15*b* is also observed as it is, i.e., the smoothly molded surface can be observed.

When compared with the second area 15*b*, the texturing processed surface of the first area 15*a* can be more clearly distinguished from other areas. Accordingly, when the texturing processed surface of the first area 15*a* is observed, it can be easily determined that the anti-fog coating has not been applied to the inner surface of the outer lens 14.

Then, a transparent anti-fog coating is applied to the inner surface of the outer lens 14 so that the first area 15*a* and the second area 15*b* of the first coating determination portion 15 are also coated with the anti-fog coating.

In this case, when the first coating determination portion 15 is visually observed, the texturing processed surface of the first area 15*a* is coated with the anti-fog coating and is thus smoothed and appears as a smooth surface. The second area 15*b* is also coated with the anti-fog coating, and maintains the same smooth surface and appearance.

When compared with the second area 15*b*, it is difficult to observe the texturing processed surface of the first area 15*a*, and the first area 15*a* can be observed or appear to have the same surface state as that of the adjacent second area 15*b*. Accordingly, when the texturing processed surface of the first area 15*a* is not observed, it can be determined that the inner surface of the outer lens 14 has been properly coated with the anti-fog coating.

In the same manner, prior to the application of the hard coating to the outer surface of the outer lens 14*a*, there is no hard coating present on the first area 16*a* and the second area 16*b* of the second coating determination portion 16( ). Accordingly, when the second coating determination portion 16 is visually inspected, the texturing processed surface of the first area 16*a* can be observed as it is. The second area 16*b* is also observed as it is, i.e., the smoothly molded surface can be observed.

When compared with the second area 16*b*, the texturing processed surface of the first area 16*a* can be more clearly distinguished from other areas. Accordingly, when the texturing processed surface of the first area 16*a* is observed, it can easily be determined that the outer surface of the outer lens 14 does not include the hard coating.

Then, a transparent hard coating is applied to the outer surface of the outer lens 14 so that the first area 16*a* and the second area 16*b* of the second coating determination portion 16 are also coated with the hard coating.

In this case, when the second coating determination portion 16 is visually observed, the texturing processed surface of the first area 16*a* is coated with the hard coating such that it appears to be smoothened. The second area 16*b* also includes the hard coating, but when observed it maintains the same smooth surface.

When compared with the second area 16*b*, the texturing processed surface of the first area 16*a* cannot be easily distinguished, and the first area 16*a* can be observed to have the same surface state as that of the adjacent second area 16*b*. Accordingly, when the texturing processed surface of the first area 16*a* is not observed, it can easily be determined that the hard coating has been properly applied to the outer surface of the outer lens 14.

With regard to the hard coating, when the surface is subjected to texturing process and finished to the level as that of TH107 (Tanazawa Hakkosha Co., Ltd.) and coated with the coating having a thickness of 6 μm or more, the smoothening of the texturing processed surface can be discriminated.

In the presently disclosed subject matter, the optical characteristics such as transparency and reflectance of the first area 15*a* (16*a*) can be measured before and after the application of coating. Then, the difference between before and after the application can be used in the process of determining whether the texturing processed surface of the first area 15*a* (16*a*) has been coated with a coating or not. This can be automatically achieved with certain systems, for example, systems that include a measuring apparatus, a CPU, and other peripheries (not shown).

When comparing optical characteristics such as transparency and reflectance of the second area 15*b* (16*b*) with those of the first area 15*a* (16*a*), the disclosed subject matter can be configured to facilitate more accurate determination of the application of the anti-fog (or hard) coating(s).

As described above, according to an exemplary embodiment, determination as to whether a coating, such as an anti-fog coating, a hard coating for surface treatment, and the like, has been applied on an inner surface and/or outer surface of an outer lens can easily be determined with apparatus that has a simple configuration.

Figure 5:
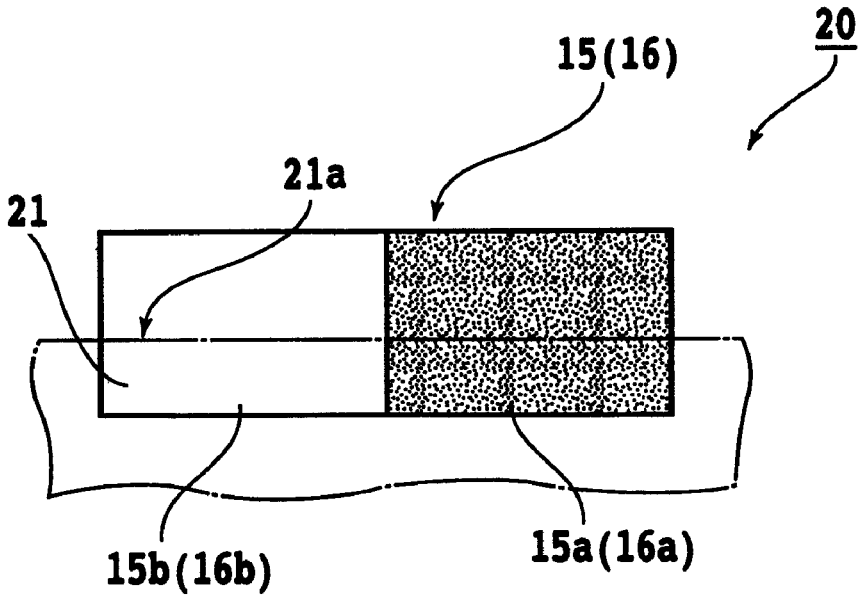
FIG. 5 is a schematic view showing the configuration of a first coating determination portion (or a second coating determination portion) of a vehicle light in accordance with a second exemplary embodiment of the presently disclosed subject matter.

FIG. 5 shows the configuration of portions of a vehicle light according to a second exemplary embodiment of the presently disclosed subject matter.

In FIG. 5, since the vehicle light 20 has almost the same configuration as that of the vehicle light 10 shown in FIGS. 1 to 4, the same components are denoted by the same reference numerals and descriptions thereof will be omitted appropriately.

The vehicle light 20 has almost the same configuration as that of the vehicle light 10 in the previous exemplary embodiment, except that the first coating determination portion 15 and the second coating determination portion 16 are partly covered with a mask 21 when applied with the coating.

In this instance, and before application of a coating, the mask 21 is disposed such that the edge 21*a* of the mask 21 extends along the width center areas of the first area 15*a* (16*a*) and the second area 15*b* (16*b*) of the first coating determination portion 15 (or the second coating determination portion 16), as shown in FIG. 5.

In the above configuration, the area covered with the mask 21 of the first coating determination portion 15 (or the second coating determination portion 16) is not coated with the anti-fog (or hard) coating. Accordingly, the area covered with the mask 21 of, in particular, the first area 15*a* (16*a*) is not coated with the anti-fog (or hard) coating so that the texturing processed surface is still exposed on its surface.

When the mask 21 is removed, a boundary line between the coated area and not-coated area can be formed by the edge 21*a* of the mask 21 on the first coating determination portion 15 (or the second coating determination portion 16). Namely, this process can provide a coated first area 15*a*, a non-coated first area 15*a* (in which a texturing processed surface is still exposed without coating), a coated second area 15*b*, and a non-coated second area 15*b* (in which a smooth non-textured surface is still exposed without coating), which results in a boundary line between the coated areas and the non-coated areas. Accordingly, even if the area around the boundary line has been coated with the transparent coating, the texturing processed surface can be visually observed. This can facilitate the detection of the position of the first coating determination portion 15 (or the second coating determination portion 16) during determination of whether the anti-fog (or hard) coating has been applied or not. Accordingly, the determination of whether the anti-fog (or hard) coating has been applied on the outer lens 14 or not can be achieved rapidly and in a reliable manner.

In a case where the optical characteristics of the surface are measured using a measuring apparatus, the coated areas and non-coated areas of the first area 15*a* (16*a*) and the second area 15*b* (16*b*) of the first coating determination portion 15 are measured and compared with one another. This can further facilitate the determination of whether the anti-fog (or hard) coating has been applied or not with improved accuracy.

In the above exemplary embodiments, the first coating determination portion 15 and the second coating determination portion 16 include respective second areas 15*b* and 16*b*. However, the presently disclosed subject matter is not limited to these exemplary embodiments, and they may not include second areas 15*b* and 16*b*.

In the above exemplary embodiments, the first coating determination portion 15 and the second coating determination portion 16 are disposed near the bonding area with the housing 13. However, the presently disclosed subject matter is not limited to these exemplary embodiments. Alternatively, these areas can be disposed at locations that cannot be visually observed with ease from outside, or can be disposed at locations that would not adversely affect the light distribution of light from the bulb 11, the reflecting surface 12, and the like.

In the above exemplary embodiments, the coating for surface treatment includes an anti-fog coating and a hard coating, but the presently disclosed subject matter is not limited to these exemplary embodiments. The presently disclosed subject matter can be applied to any transparent or semi-transparent coatings for surface treatment for which it is difficult to be discriminated after coated.

In the above exemplary embodiments, the vehicle light serves as a headlight for a vehicle. However, the presently disclosed subject matter is not limited to these exemplary embodiments. Other examples may include an auxiliary headlight, a signal light, and other types of vehicle related lights.

According to the presently disclosed subject matter, a vehicle light can be provided with a simple configuration by which determination as to whether a coating, such as an anti-fog coating, a hard coating for surface treatment, and the like has been applied, can be facilitated. Furthermore, a method for manufacturing such a vehicle light can be provided.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicle light comprising:

a housing having a front open end opened in an illumination direction;

a light source disposed within the housing;

a reflecting surface disposed within the housing and configured to reflect light from the light source towards the illumination direction, the reflecting surface being concave toward the illumination direction; and an outer lens disposed in front of the reflecting surface and configured to hermetically close the front open end of the housing, the outer lens having an inner surface and an outer surface and at least one of the inner surface and the outer surface includes a coating, the outer lens further having a coating determination portion, the coating determination portion including a first area which is textured as compared to immediately adjacent areas and a second area which is adjacent to the first area side by side on a same plane and is smooth as compared to the first area, and the coating determination portion being disposed on at least one of the inner surface and the outer surface of the outer lens, and the coating being applied to at least part of both the first area and the second area.

2. The vehicle light according to claim 1, wherein the outer lens and the housing are bonded to each other at a bonding area which includes at least part of the first area and the second area of the outer lens.

3. The vehicle light according to claim 1, wherein the coating is an anti-fog coating located on the inner surface of the outer lens.

4. The vehicle light according to claim 2, wherein the coating is an anti-fog coating located on the inner surface of the outer lens.

5. The vehicle light according to claim 2, wherein the coating is a hard coating located on the outer surface of the outer lens.

6. The vehicle light according to claim 1, wherein the coating is a hard coating located on the outer surface of the outer lens.

7. A method for manufacturing a vehicle light, comprising:

forming an outer lens having an inner surface and an outer surface, the outer lens having a coating determination portion, the coating determination portion including a first area which is textured as compared to immediately adjacent areas and a second area which is adjacent to the first area side by side on a same plane and is smooth as compared to the first area, the coating determination portion being located on at least one of the inner surface and the outer surface;

applying a coating on at least one of the inner surface and the outer surface of the outer lens; and fixing the outer lens to a housing of the vehicle light, wherein in the applying of the coating, the coating is applied to at least part of both the first area and the second area of the outer lens.

8. The method for manufacturing a vehicle light according to claim 7, further comprising, after the applying of the coating and prior to the fixing of the outer lens to the housing, determining whether or not the outer lens is properly coated with the coating based on whether or not the first area and the second area have been coated.

9. The method for manufacturing a vehicle light according to claim 7, further comprising, after the applying of the coating and prior to releasing of the outer lens from a jig, determining whether the outer lens is properly coated with the coating based on whether or not the first area and the second area have been coated.

10. The method for manufacturing a vehicle light according to claim 8, wherein the determining of whether or not the outer lens is properly coated with the coating is achieved by visually inspecting and determining whether the first area and the second area have or have not been coated.

11. The method for manufacturing a vehicle light according to claim 9, wherein the determining of whether or not the outer lens is properly coated with the coating is achieved by visually inspecting the first area and the second area and determining whether or not the first area and the second area have been coated.

12. The method for manufacturing a vehicle light according to claim 8, wherein the determining of whether or not the outer lens is properly coated with the coating is achieved by optically measuring at least one of a transparency and a reflectance of the first area and the second area.

13. The method for manufacturing a vehicle light according to claim 9, wherein the determining of whether or not the outer lens is properly coated with the coating is achieved by optically measuring at least one of a transparency and a reflectance of the first area and the second area.

14. The method for manufacturing a vehicle light according to claim 7, wherein the coating is an anti-fog coating located adjacent the inner surface of the outer lens.

15. The method for manufacturing a vehicle light according to claim 8, wherein the coating is an anti-fog coating located adjacent the inner surface of the outer lens.

16. The method for manufacturing a vehicle light according to claim 9, wherein the coating is an anti-fog coating located adjacent the inner surface of the outer lens.

17. The method for manufacturing a vehicle light according to claim 7, wherein the coating is a hard coating located adjacent the outer surface of the outer lens.

18. The method for manufacturing a vehicle light according to claim 8, wherein the coating is a hard coating located adjacent the outer surface of the outer lens.

19. The method for manufacturing a vehicle light according to claim 9, wherein the coating is a hard coating located adjacent the outer surface of the outer lens.

* * * * *